US009217194B2

(12) United States Patent
Dubois et al.

(10) Patent No.: US 9,217,194 B2
(45) Date of Patent: Dec. 22, 2015

(54) SYSTEM FOR REDUCING THE WIPING GAS CONSUMPTION IN AN AIR KNIFE

(71) Applicant: Cockerill Maintenance & Ingénierie S.A., Seraing (BE)

(72) Inventors: Michel Dubois, Boncelles (BE); Brice Van Houtte, Embourg (BE)

(73) Assignee: Cockerill Maintenance & Ingénierie S.A., Seraing (BE)

( * ) Notice: Subject to any disclaimer, the term of this patent is extended or adjusted under 35 U.S.C. 154(b) by 0 days.

(21) Appl. No.: 14/380,313

(22) PCT Filed: Feb. 13, 2013

(86) PCT No.: PCT/EP2013/052887
§ 371 (c)(1),
(2) Date: Aug. 21, 2014

(87) PCT Pub. No.: WO2013/124196
PCT Pub. Date: Aug. 29, 2013

(65) Prior Publication Data

US 2015/0040824 A1 Feb. 12, 2015

(30) Foreign Application Priority Data

Feb. 21, 2012 (EP) ..... 12156291

(51) Int. Cl.

| | |
|---|---|
| ***B05C 11/06*** | (2006.01) |
| ***C23C 2/20*** | (2006.01) |
| ***B05B 1/30*** | (2006.01) |
| ***B05B 1/00*** | (2006.01) |
| ***F26B 21/00*** | (2006.01) |
| ***D21H 25/16*** | (2006.01) |
| ***D21H 19/00*** | (2006.01) |
| ***F26B 13/28*** | (2006.01) |
| ***C23C 2/00*** | (2006.01) |

(52) U.S. Cl.
CPC . *C23C 2/20* (2013.01); *B05B 1/005* (2013.01); *B05B 1/3033* (2013.01); *B05C 11/06* (2013.01); *C23C 2/003* (2013.01); *D21H 19/00* (2013.01); *D21H 25/16* (2013.01); *F26B 13/28* (2013.01); *F26B 21/004* (2013.01)

(58) Field of Classification Search
CPC ..... B05C 11/06; C23C 2/20; C23C 2/003; D21H 25/16; D21H 19/00; B05B 1/3033; B05B 1/005; F26B 21/004; F26B 13/28
USPC ..... 118/62, 63; 427/348, 349; 15/300.1, 15/306.1, 309.1, 309.2; 34/653, 655
See application file for complete search history.

(56) References Cited

U.S. PATENT DOCUMENTS

| | | | | |
|---|---|---|---|---|
| 4,132,013 | A * | 1/1979 | Ferrarell | 34/653 |
| 4,524,716 | A | 6/1985 | Mueller | |
| 2012/0160268 | A1 * | 6/2012 | Massey | 134/15 |

FOREIGN PATENT DOCUMENTS

| | | |
|---|---|---|
| EP | 0 249 234 A1 | 12/1987 |
| JP | 62-133056 | 6/1987 |
| JP | 2006-274381 | 10/2006 |
| KR | 2006-0003447 | 1/2006 |
| WO | WO 2007/142397 A1 | 12/2007 |

* cited by examiner

*Primary Examiner* — Laura Edwards
(74) *Attorney, Agent, or Firm* — Reinhart Boerner Van Deuren P.C.

(57) ABSTRACT

The present invention relates to a device for controlling the thickness of a coating made of a liquid film on a moving strip (3), characterized in that automated structure for reducing the gas flow at each of said nozzle sides comprise a moving carriage (10) guiding a retractable cable (9) able to be applied respectively onto and out of the gas discharge opening (4), inside the nozzle chamber (5) and in that, at each transversal side of the nozzle (1), a transition, between an external nozzle section where the gas flow is reduced and an internal nozzle section where the gas flow is not reduced, is assured by two together-moving grooved wheels or pulleys (6, 7) connected to the moving carriage (10), located side by side and having their axis perpendicular to the nozzle, so that the cable (9) is successively located against the opening (4) on an external side of the first pulley (6), between the two pulleys (6, 7) and distant from the opening (4) on an internal side of the second pulley (7).

11 Claims, 4 Drawing Sheets

SYSTEM FOR REDUCING THE WIPING GAS CONSUMPTION IN AN AIR KNIFE

FIELD OF THE INVENTION

The present invention relates to a gas wiping device for controlling the thickness of a liquid film deposited on a running strip. A typical example is a device intended for gas wiping of a liquid metal on wide coated steel sheets, such as those obtained by hot dip coating.

GENERAL BACKGROUND AND PRIOR ART

The "air knife" method is a well-known process used to wipe the excess of liquid entrained by a running strip going out of a bath. A typical air knife uses chamber pressure as high as 700 mbar leading to an exit gas velocity close to the sound level. The air discharge opening is usually in the range of 0.5 to 2 mm.

The air wiping process generates some waves in the coating due to the high turbulence occurring when the gas jet enters in the atmosphere. This high turbulence cannot be reduced due to the high level of shear forces. However, those waves tend to be reduced in amplitude with time due to the levelling process that occurs in the liquid state, driven by the liquid surface tension.

A countermeasure to limit the amplitude of those waves on the aspect of the finished product consisting for example in a zinc coated steel sheet, resides in the replacement of air as wiping medium by nitrogen ($N_2$). This method indeed induces a significant reduction of the oxidation of the liquid coating and helps keeping a high surface tension. Since the surface tension of the liquid metal is kept high, the final surface after solidification is a smoother surface when $N_2$ is used. This leads to a much better surface appearance after painting. A typical case is that of the galvanized steel sheets used for the exposed panels in automobiles.

In case of low line speed, air can generate defects such as those shown on FIG. 1 that are suspected to be due to the metal oxidation. Again, $N_2$ wiping helps to significantly reduce these defects.

Finally, air wiping can induce what is called a "cloudy aspect" as shown in FIG. 2 and which is due to differential oxidation of the surface. Here again, $N_2$ wiping is used to drastically improve such a poor surface quality.

A related problem is that the use of $N_2$ is expensive since a flow as high as 800 $Nm^3/h$ and per meter of nozzle length may be used. The cost becomes especially high in case of wiping narrow sheets because the gas exits the nozzle opening along the whole length of the nozzle whereas wiping is of course only required in front of the strip. All the $N_2$ flow that is outside the strip is indeed lost.

The solution to reduce those losses and so reduce the operating costs consists in a flexible closing of the air discharge opening in the region where the gas has no wiping effect. To that purpose different methods have been proposed like:

- reduction of the nozzle opening through an action on the lips of the nozzle 1 by a mechanical means. FIG. 3, for example, shows such a typical opening of this type;
- using a foil inside the nozzle as shown on FIG. 4, the foil being referenced 2 on the figure. The foil 2 is moved by motors located at the edges of the nozzle (not shown), which means that the foil is pushed when the opening 4 must be closed or reduced (see EP 0 249 234 A1, Blow-off device for the continuous two-sided coating of strip metal, Duma Konstructionsbuero)

The previous methods present various drawbacks due to the operating window used in production as well as the requirements on the final coating as described here below:

- the mechanical closing of the opening has side effects on the control of the opening in front of the strip, which impacts the control of the final coating thickness. In addition, due to mechanical constraints, the deformation of the lips should be limited to avoid their plastic deformation;
- the foil suffers from the force it has to resist. To take an example, when a chamber pressure of about 600 mbar is used, the force on the surface 2 (FIG. 4) measuring only 5 mm high for example is 120 N on a 400 mm long mask. This means a friction force when the latter is moved of at least 12 N. As the foil is usually thin, it cannot be pushed along the nozzle without buckling;
- at the location where the gas flow is stopped due to the masking device, the nozzle temperature increases because it is not cooled anymore by the gas, while being still heated by the radiation of the liquid metal. This leads to a thermal expansion and deformation of the opening all along the nozzle, due to the temperature gradients. This deformation can either be elastic, which would not be a too critical situation, or plastic, depending on the nozzle design, which will impact the coating weight uniformity in this case.

Document U.S. Pat. No. 4,524,716 A discloses an adjustable gas knife, comprising: elongated nozzle means having an elongated nozzle opening for projecting a sheet of gas; elongated flexible gas flow modification means located within said nozzle for modifying the rate of flow of said gas; and differential adjusting means for selectively adjusting the position of said gas flow modification means relative to said nozzle opening at a plurality of positions along the length of said gas flow modification means to thereby selectively modify the rate of flow of said gas through said nozzle opening.

AIMS OF THE INVENTION

The present invention aims at avoiding the drawbacks of prior art.

More particularly, a goal of the invention is to obtain a movable device which allows reducing the gas consumption by reduction of the gas flow outside the strip and that can operate with a differential pressure chamber-ambiance as high as 1 bar.

A further goal of the invention is to provide a proper closing of the useless nozzle opening section at each side of the strip in the case of narrow strips handling.

The invention also intends to allow keeping some cooling of the nozzle openings which limit their thermal deformation.

SUMMARY OF THE INVENTION

The present invention relates to a device for controlling the thickness of a coating made of a liquid film on a moving strip, comprising a nozzle fed with a pressurized gas in a chamber of the nozzle, said chamber being terminated by nozzle lips making an elongated opening for discharging the pressurized gas onto the moving strip, said elongated opening being provided with automated means for reducing the gas flow at each transversal side of the nozzle outside the strip width, characterised in that said automated means for reducing the gas flow at each of said nozzle sides comprise a moving carriage guiding a retractable cable able to be deposited or applied respectively onto and out of the gas discharge opening, inside the nozzle chamber, and in that, at each transversal side of the nozzle, a transition, between an external nozzle section where the gas flow is reduced and an internal nozzle section where the gas flow is not reduced, is assured by means of two together-moving grooved wheels or pulleys connected to the moving carriage, located side by side and having their axis perpendicular to the nozzle, so that the cable is successively located against the opening on an external side of the first pulley, between the two pulleys and distant from the opening on an internal side of the second pulley.

According to preferred embodiments, the device of the invention is further limited by one or a suitable combination of the following characteristics:

- each moving carriage is bidirectional and independently moved by a motorized mechanical device;
- the mechanical device is a screw;
- the mechanical device is another cable or similar device;
- the cable is permanently under tension;
- the cable is made of a heat-resistant material, preferably of steel;
- the diameter of the cable is comprised between 1 and 10 mm, preferably between 2 and 5 mm. Because of the existing roughness of the cable, the closure is not total and a certain flow is still passing through the nozzle lips, providing some advantageous cooling effect;
- the bidirectional carriage with its grooved wheels or pulleys and the motorized mechanical device are located inside the nozzle chamber;
- the cable is selected and adjusted so that the residual gas flow at the nozzle opening where the cable is applied is less than 20% of the value where the cable is not applied.

SHORT DESCRIPTION OF THE DRAWINGS

Figure 1:
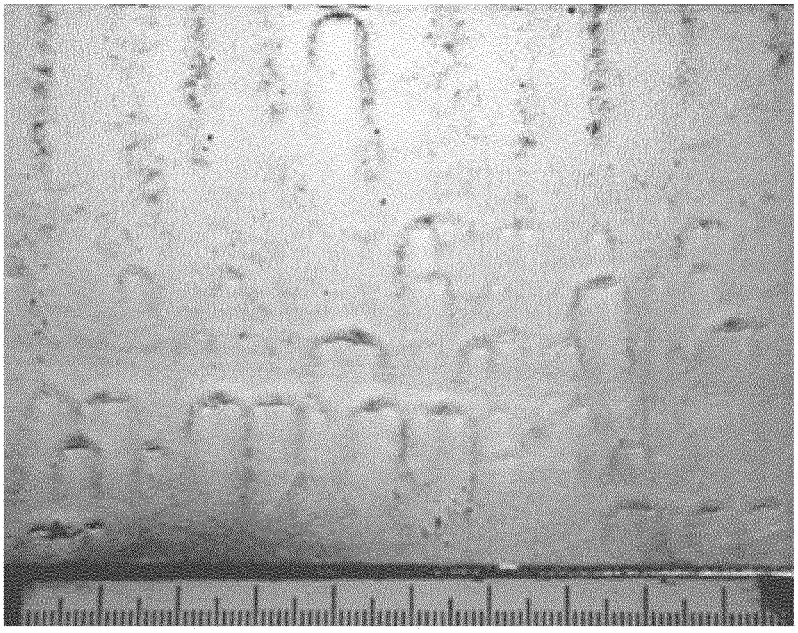
FIG. 1 shows defects induced by air wiping at low line speed.
Figure 2:
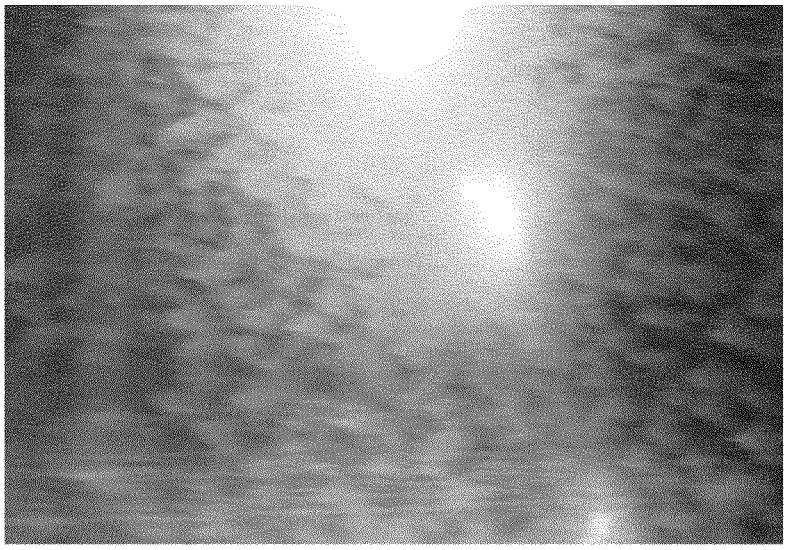
FIG. 2 shows the phenomenon of cloudy aspect induced by air wiping and due to differential oxidation of the surface.
Figure 3:
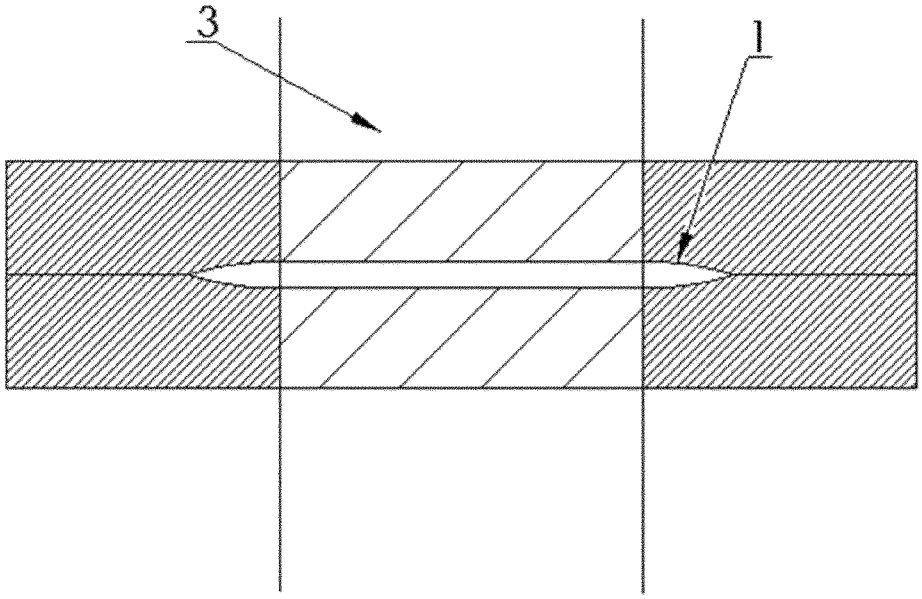

FIG. 3 schematically represents a reduction of the nozzle opening through action on the lips of the nozzle by a mechanical means, according to prior art.

Figure 4:
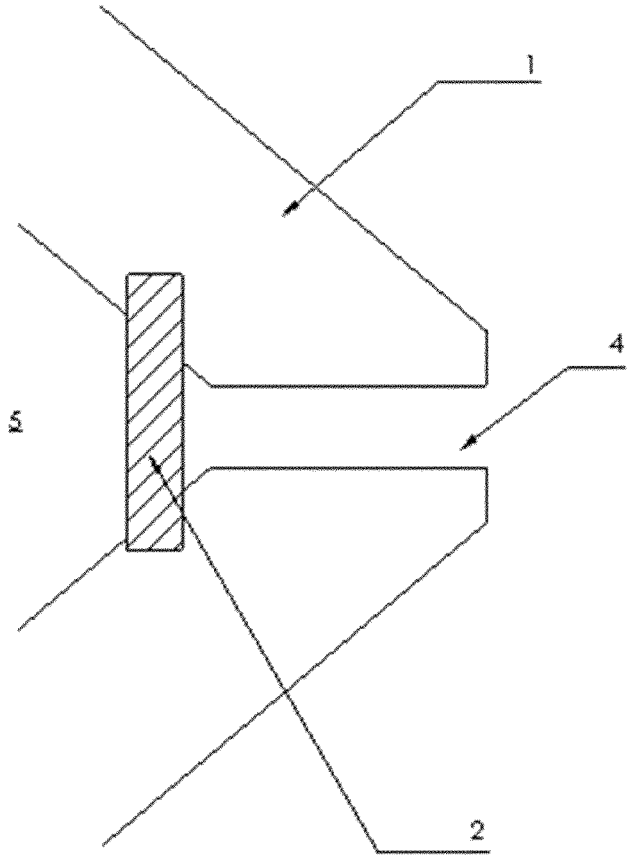

FIG. 4 schematically represents an inside foil incorporated inside a nozzle in order to limit the opening of the nozzle according to prior art.

Figure 5:
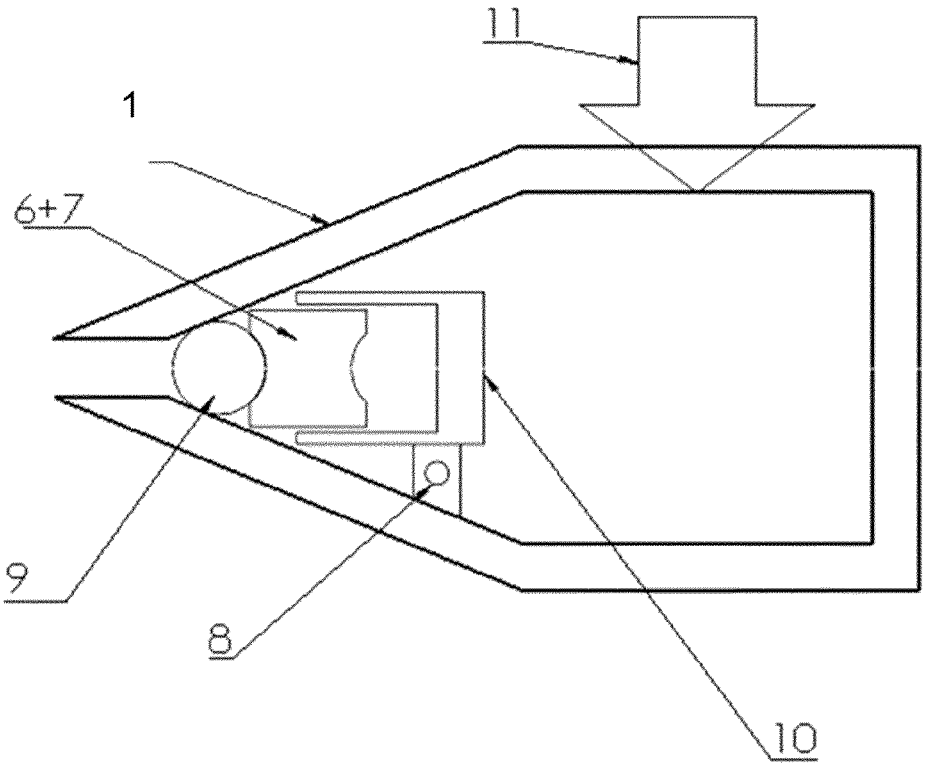

FIG. 5 is a cross-section of a preferred embodiment according to the present invention.

Figure 6:
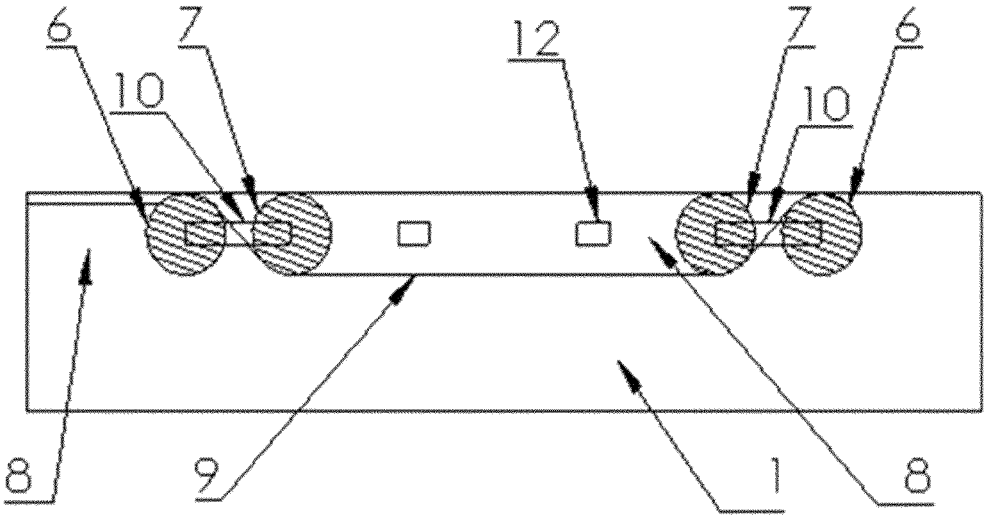

FIG. 6 is a schematic top view of a nozzle according to a preferred embodiment of the invention, showing an example of cable positioning, applied against the slit opening at the edges of the nozzle and in a retracted position.

Figure 7:
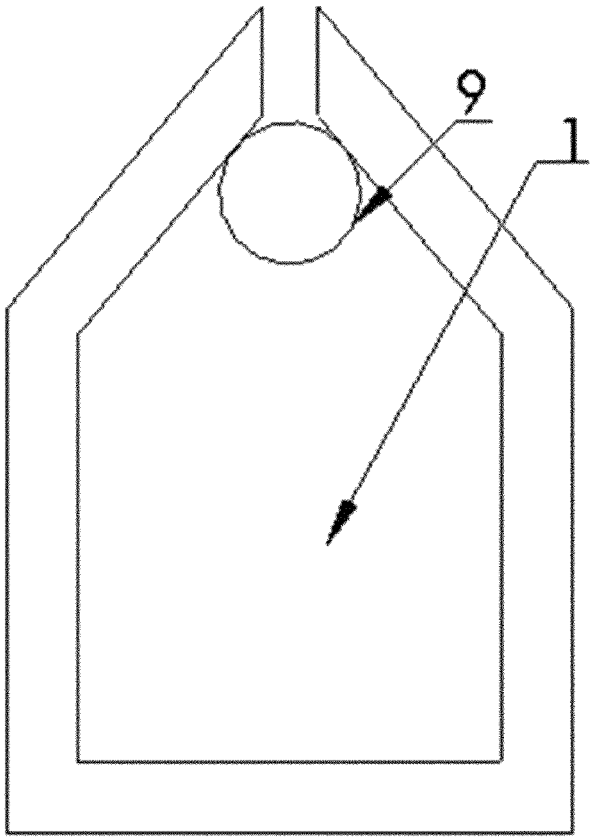

FIG. 7 shows, in a cross-sectional view, a typical position of the cable once applied against the slit of the nozzle.

Figure 8:
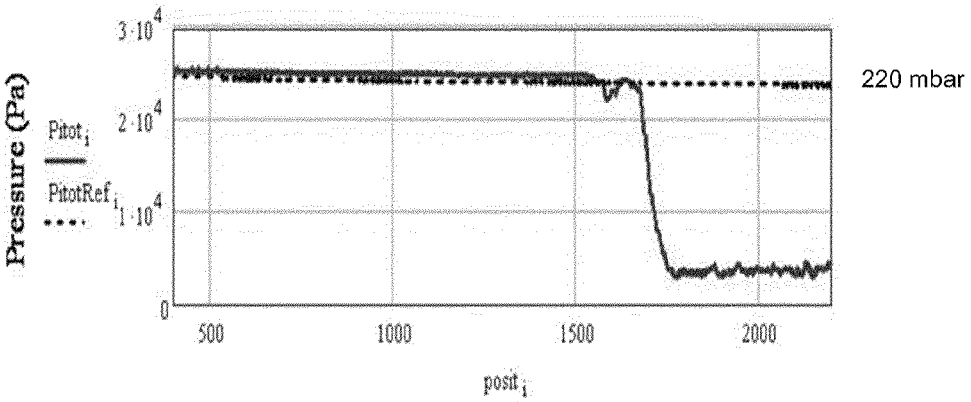

FIG. 8 shows specific measurements of the dynamic pressure at the exit of the nozzle close to the region where the cable is applied.

DETAILED DESCRIPTION OF THE INVENTION AND PREFERRED EMBODIMENTS

The invention relates to a new device to reduce the gas flow of the nozzle outside the strip width section. It consists in using a cable either made of steel or of another heat resistant material that is alternately deposited (or placed) and removed from the nozzle opening by a moving carriage installed inside the nozzle chamber. A carriage is provided at each side of the nozzle and can be moved independently of the carriage at the opposite side by means of a mechanical device like another cable, a screw or similar. Still according to the invention, the cable is permanently under tension.

The diameter of the cable is typically between 2 and 5 mm. Because of a certain roughness of the cable the closure is not total and a certain leak flow is still passing through the lips of the opening, giving some cooling effect to the nozzle.

FIG. 5 and FIG. 6 show the masking system according to the invention consisting in a cable 9. The system applying the cable 9 on the nozzle lips comprises the carriage 10, a mechanical driving system 8 as well as two grooved wheels or pulleys 6, 7.

FIG. 6 shows an example of the position of the cable 9, applied against the opening 4 at each edge of the nozzle 1 in a retracted position.

FIG. 7 shows a typical cross-sectional position of the cable 9 in place in the nozzle opening 4 when it is applied.

The device of the invention has the following advantages compared to prior art:

- possible and easy retraction of the closing system at a pressure as high as 1 bar in the chamber;
- existence of some residual flow locally where the opening is closed, which is suitable to keep some cooling of the lips;
- individually controlled adjustment on each side thanks to separate driving systems for positioning the carriage.

EXAMPLE

In a reduction to practice, an embodiment of a device according to the invention has been installed on a gas wiping nozzle (not shown).

In this example, the nozzle 1 is about 2.3 m long; the opening 4 thereof can be between 1 and 2 mm.

The cable 9 has a diameter of 5 mm and is applied or retracted by a carriage having the two grooved wheels 6, 7, where one carriage 10 is present at each side of the nozzle. The carriage is moved by a motorized screw. The internal movement of the carriage 10 is limited by a carriage stop 12.

Tests have been conducted with an internal pressure in the chamber of 220 mb and the dynamic pressure at the exit measured by very small Pitot tubes (FIG. 8). It can be observed at the right of the graph that the dynamic pressure is significantly reduced where the cable is applied. A detailed analysis of the results have shown that the residual flow where the cable is applied is about 15% of what it would be without the device in case of an opening of 1 mm and 10% in case of an opening of 2 mm.

LIST OF REFERENCE SYMBOLS

1. nozzle
2. foil for closing nozzle opening
3. strip
4. slit
5. pressurized nozzle chamber
6. wheel
7. wheel
8. mechanical driving system
9. cable
10. driving carriage
11. air feeding
12. carriage stop

The invention claimed is:

1. A device for controlling the thickness of a coating made of a liquid film on a moving strip (3), comprising a nozzle (1) fed with a pressurized gas (11) in a chamber (5) of the nozzle, said chamber (5) being terminated by nozzle lips making an elongated opening (4) for discharging the pressurized gas onto the moving strip (3), said elongated opening (4) being provided with automated means for reducing gas flow at each transversal side of the nozzle (1) outside the strip width, characterised in that said automated means for reducing the gas flow at each of said nozzle sides comprise a moving carriage (10) guiding a retractable cable (9) able to be applied respectively onto and out of the gas discharge opening (4), inside the nozzle chamber (5), and in that, at each transversal side of the nozzle, a transition, between an external nozzle section where the gas flow is reduced and an internal nozzle section where the gas flow is not reduced, is assured by two together-moving grooved wheels or pulleys (6, 7) connected to the moving carriage (10), located side by side and having their axis perpendicular to the nozzle, so that the cable (9) is successively located against the opening (4) on an external side of the first pulley (6), between the two pulleys (6, 7) and distant from the opening (4) on an internal side of the second pulley (7).

2. Device according to claim 1, characterised in that each moving carriage (10) is bidirectional and independently moved by a motorized mechanical device (8).

3. Device according to claim 2, characterised in that the mechanical device (8) is a screw.

4. Device according to claim 2, characterised in that the mechanical device (8) is another cable.

5. Device according to claim 1, characterised in that the cable (9) is permanently under tension.

6. Device according to claim 1, characterised in that the cable (9) is made of a heat-resistant material.

7. Device according to claim 6, characterised in that the cable (9) is made of steel.

8. Device according to claim 1, characterised in that the diameter of the cable (9) is comprised between 1 and 10 mm.

9. Device according to claim 8, characterised in that the diameter of the cable (9) is comprised between 2 and 5 mm.

10. Device according to claim 2, characterised in that the bidirectional carriage (10) with its grooved wheels or pulleys (6, 7) and the motorized mechanical device (8) are located inside the nozzle chamber (5).

11. Device according to claim 1, characterised in that the cable (9) is selected and adjusted so that the residual gas flow at the nozzle opening (4) where the cable is applied is less than 20% of the value where the cable is not applied.

* * * * *